US012723403B2

(12) United States Patent
Rupnow

(10) Patent No.: US 12,723,403 B2
(45) Date of Patent: Sep. 1, 2026

(54) FIRE BARRIER SLIDING MOUNTING SYSTEM

(71) Applicant: InPro Corporation, Muskego, WI (US)

(72) Inventor: Calvin T. Rupnow, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 161 days.

(21) Appl. No.: 18/600,393

(22) Filed: Mar. 8, 2024

(65) Prior Publication Data

US 2025/0283325 A1 Sep. 11, 2025

(51) Int. Cl.
*E04B 1/94* (2006.01)

(52) U.S. Cl.
CPC ..... *E04B 1/948* (2013.01); *E04B 1/947* (2013.01)

(58) Field of Classification Search
CPC ..... E04B 1/948
See application file for complete search history.

(56) References Cited

U.S. PATENT DOCUMENTS 4,942,710 A * 7/1990 Rumsey ..... E04B 1/6815 52/468
5,461,838 A * 10/1995 Heller ..... E04B 1/948 52/573.1
5,875,598 A * 3/1999 Batten ..... E04B 1/681 52/573.1
6,112,488 A * 9/2000 Olson ..... E04B 1/948 52/573.1
6,131,352 A * 10/2000 Barnes ..... E04B 1/948 52/396.04
7,941,981 B2 5/2011 Shaw
8,082,715 B2 * 12/2011 Shaw ..... E04B 1/948 52/396.04
8,286,397 B2 10/2012 Shaw
8,935,897 B2 * 1/2015 Shaw ..... E04B 1/948 52/396.04
11,459,749 B2 * 10/2022 Harder ..... E04B 1/947
2003/0005657 A1 * 1/2003 Visser ..... E04B 1/6804 52/396.01
2005/0102941 A1 * 5/2005 Barr ..... E04B 5/023 52/459
2010/0115868 A1 * 5/2010 Shaw ..... E04B 1/948 52/396.01
2014/0075866 A1 * 3/2014 Hilburn, Jr. ..... E04B 1/947 52/232
2020/0340241 A1 * 10/2020 Harder ..... E04B 1/947
2025/0283325 A1 * 9/2025 Rupnow ..... E04B 1/948

* cited by examiner

*Primary Examiner* — Brian D Mattei
(74) *Attorney, Agent, or Firm* — Reinhart Boerner Van Deuren s.c.

(57) ABSTRACT

A fire barrier system including a sliding mounting system and being configured to extend across a gap between floor sections is described. The fire barrier system includes a fire barrier fabricated from fire-resistant protective materials draped between the floor sections and a mounting system coupled to the fire barrier and to one of the floor sections. The mounting system includes a mounting rail extending in a lateral direction along the floor section and having a mounting channel, a hook receiver, and a rounded lip. The mounting system includes a retaining bracket coupled to the fire barrier and including a hook end and a rounded end. The retaining bracket is inserted into the mounting channel perpendicular to the lateral direction and rotated into a coupling position within the mounting rail.

21 Claims, 7 Drawing Sheets

FIRE BARRIER SLIDING MOUNTING SYSTEM

BACKGROUND OF THE INVENTION

The present invention relates generally to the field of fire barriers. The present invention relates specifically to a fire barrier that is installed into floor-to-floor gaps and a sliding mounting system for attaching the fire barrier to sections of flooring.

SUMMARY OF THE INVENTION

One embodiment of the invention relates to a fire barrier system configured to cover a gap between a first architectural surface and a second architectural surface. The fire barrier system includes a fire barrier fabricated from fire-resistant protective materials. The fire barrier includes a first side, a second side, and a middle section draped between the first side and the second side. The fire barrier system also includes a first mounting system coupled to the first side of the fire barrier and to the first architectural surface. The first mounting system includes a mounting rail coupled to the first architectural surface and extending in a lateral direction along the first architectural surface. The mounting rail includes a mounting channel that extends in the lateral direction, a hook receiver, and a rounded lip. The first mounting system includes a retaining bracket coupled to the first side of the fire barrier, the retaining bracket including a hook end and a rounded end. The fire barrier system includes a second mounting system coupled to the second side of the fire barrier and to the second architectural surface. The retaining bracket is configured to be inserted into the mounting channel from a longitudinal direction that is perpendicular to the lateral direction such that the hook end of the retaining bracket engages the hook receiver of the mounting rail, and the rounded lip of the mounting rail retains the rounded end of the retaining bracket.

Another embodiment of the invention relates to a fire barrier system configured to cover a gap between a first architectural surface and a second architectural surface. The fire barrier system includes a fire barrier fabricated from fire-resistant protective materials. The fire barrier includes a first side, a second side, and a middle section draped between the first side and the second side. The fire barrier system includes a first mounting system coupled to the first side of the fire barrier and to the first architectural surface. The first mounting system includes a mounting rail coupled to the first architectural surface and extending in a lateral direction along the first architectural surface, the mounting rail including a mounting channel that extends in the lateral direction and a hook receiver defining an upper cavity. The first mounting system includes a retaining bracket coupled to the first side of the fire barrier, the retaining bracket including a hook end. The fire barrier system includes a second mounting system coupled to the second side of the fire barrier and to the second architectural surface. The mounting rail and retaining bracket are configured such that the hook end of the retaining bracket can be inserted into the upper cavity of the hook receiver and the retaining bracket can then rotate with respect to the mounting rail into the mounting channel to couple the retaining bracket to the mounting rail, the retaining bracket rotating about an axis extending in the lateral direction.

Another embodiment of the invention relates to a method for installing a fire barrier system configured to cover a gap between a first architectural surface and a second architectural surface. The method includes coupling a mounting rail to the first architectural surface such that the mounting rail extends in a lateral direction along the first architectural surface and includes a mounting channel that extends in the lateral direction and a hook receiver defining an upper cavity. The method includes coupling a mounting system to the second architectural surface and coupling a retaining bracket to the mounting rail by inserting a hook end of the retaining bracket into the mounting channel from a longitudinal direction that is perpendicular to the lateral direction, raising the hook end of the retaining bracket into the upper cavity of the mounting rail, and rotating the retaining bracket with respect to the mounting rail into the mounting channel such that the hook end of the retaining bracket engages the hook receiver of the mounting rail to releasably retain the retaining bracket in the mounting channel of the mounting rail, such that the retaining bracket rotates about an axis extending in the lateral direction. The method includes coupling a first side of a fire barrier to the mounting system and coupling a second side of the fire barrier to the retaining bracket. The fire barrier is fabricated from fire-resistant protective materials and includes a middle section draped between the first side and the second side.

Additional features and advantages will be set forth in the detailed description which follows, and, in part, will be readily apparent to those skilled in the art from the description or recognized by practicing the embodiments as described in the written description and claims thereof, as well as the appended drawings. It is to be understood that both the foregoing general description and the following detailed description are exemplary.

The accompanying drawings are included to provide further understanding and are incorporated in and constitute part of the specification. The drawings illustrate one or more embodiment, and together with the description serve to explain the principles and operation of various embodiments.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a fire barrier having a fire barrier mounting system and being configured to extend across a gap between architectural surfaces are shown. Embodiments of the fire barrier mounting system discussed herein include an innovative design to provide for a variety of desired characteristics, including releasable attachment of the fire barrier to architectural surfaces, such as floor sections, that allows for relative motion of components of the mounting system in a lateral direction to accommodate lateral displacement between architectural surfaces, and a means of assembling the mounting system without requiring access to the lateral ends of a mounting rail of the mounting system. Typically, traditional fire barrier mounting systems are assembled by attaching a mounting rail to an architectural surface, such that the mounting rail extends laterally across the architectural surface. A frame that is coupled to a fire barrier or blanket is then slid laterally into an end of the mounting rail. In order to assemble the mounting system, clearance of roughly the length of the frame is required from the end of the mounting rail to align the frame with the mounting rail. Such clearance may not be available if the mounting rail is positioned close to a corner or wall connecting to the architectural surface.

Applicant has found it beneficial to provide a fire barrier mounting system that can be assembled by inserting a portion of a frame or retaining bracket that is coupled to a fire barrier or blanket into an opening in a mounting rail from a longitudinal direction that is perpendicular to the direction the mounting rail extends across. This allows users to easily and quickly assemble and implement the fire barrier without requiring access to the lateral ends of the mounting rail. This also allows users to easily release the fire barrier from the mounting system, for example, to inspect the mounting system or install replacement components.

Figure 1:
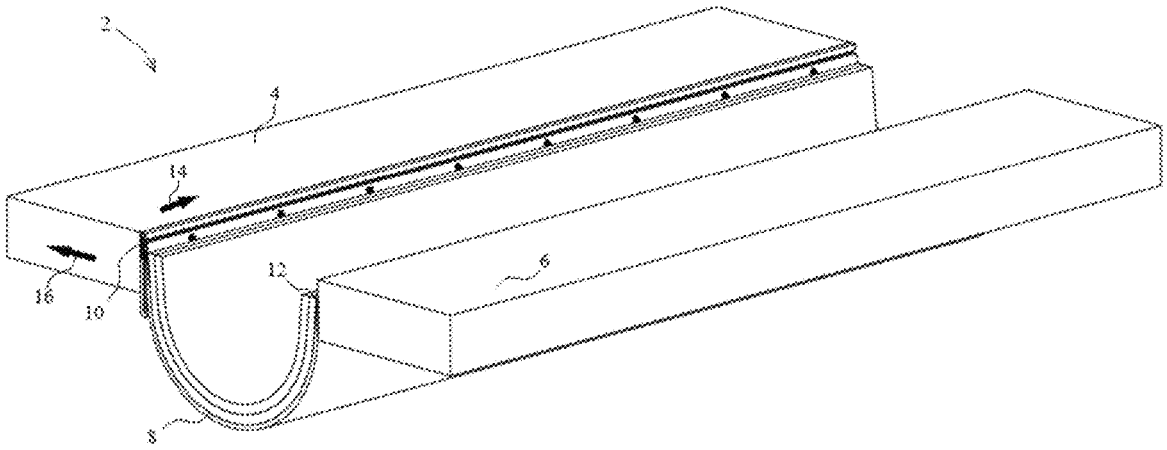
FIG. 1 is a perspective view of a fire barrier system, according to an exemplary embodiment.

Referring to FIG. 1, a fire barrier assembly 2 extending between a first architectural surface 4 and a second architectural surface 6 is shown, according to an exemplary embodiment. Fire barrier assembly 2 includes a fire barrier 8, a first mounting system 10, and a second mounting system 12. First mounting system 10 is coupled to first architectural surface 4 and coupled to fire barrier 8. Second mounting system 12 is coupled to second architectural surface 6 and coupled to fire barrier 8. Both first mounting system 10 and second mounting system 12 extend in a lateral direction 14 along first architectural surface 4 and second architectural surface 6. First architectural surface 4 and second architectural surface 6 are spaced apart from each other in a longitudinal direction 16 that is perpendicular to lateral direction 14. In some embodiments, the distance between first architectural surface 4 and second architectural surface 6 is greater than 6 inches, greater than 20 inches, greater than 24 inches, greater than 30 inches, greater than 40 inches, and/or greater than 50 inches. In a specific embodiment, the distance between first architectural surface 4 and second architectural surface 6 is about 32 inches. First architectural surface 4 and second architectural surface 6 can be floor sections of adjacent building sections.

Figure 2:
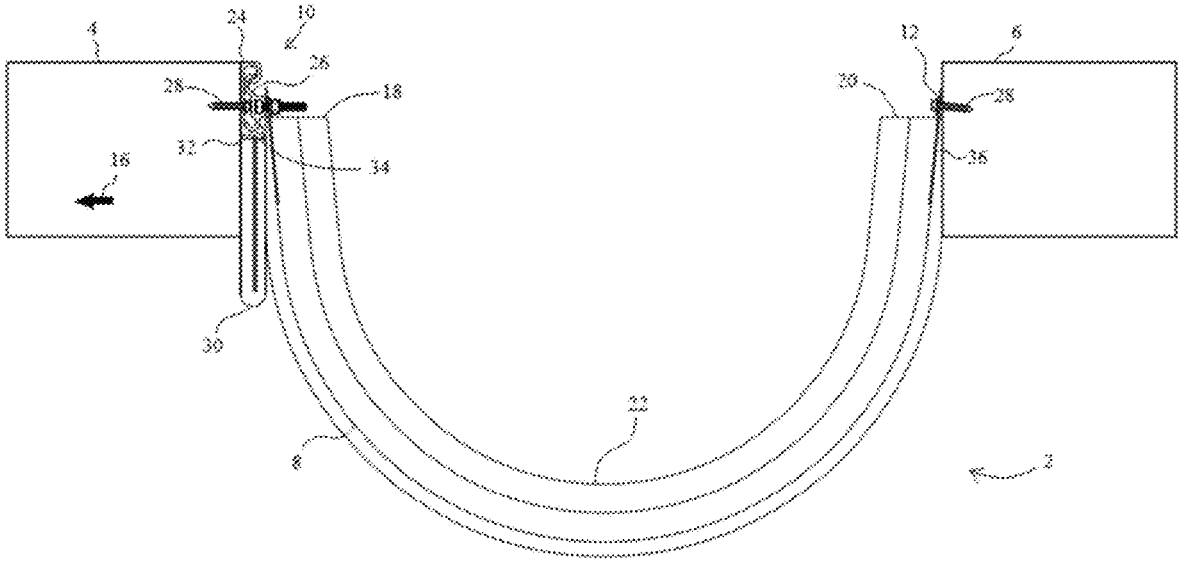
FIG. 2 is a front side view of the fire barrier system of FIG. 1, according to an exemplary embodiment.

As shown in FIG. 2, fire barrier 8 includes a first side 18, a second side 20, and a middle section 22. First side 18 of fire barrier 8 is coupled to first mounting system 10. Second side 20 of fire barrier 8 is coupled to second mounting system 12. Middle section 22 of fire barrier 8 extends between the first side 18 and the second side 20. Fire barrier 8 is formed from a flexible material such that middle section 22 drapes or hangs between first architectural surface 4 and second architectural surface 6. Fire barrier 8 is formed from fire-resistant protective materials. In some embodiments, the fire-resistant protective materials forming fire barrier 8 include one or more insulation blanket layers, intumescent layers, fire-resistant supporting mesh layers, metallic backing layers, and/or outer protective cloth layers. Fire barrier 8 can be a fire blanket. In the event of a fire, fire barrier 8 is configured to prevent or limit spreading of gases, flames, heat, or smoke through the space between first architectural surface 4 and second architectural surface 6.

First mounting system 10 includes a mounting rail 24 and a retaining bracket 26. Mounting rail 24 is rigidly coupled to first architectural surface 4 by mounting fasteners 28. Retaining bracket 26 is coupled within mounting rail 24 to attach fire barrier 8 to first architectural surface 4 such that fire barrier 8 extends across the gap between first architectural surface 4 and second architectural surface 6. In a specific embodiment, mounting rail 24 and/or retaining bracket 26 are formed from aluminum as integrally formed, continuous, contiguous components, respectively, through an extrusion process such that mounting rail 24 and/or retaining bracket 26 are aluminum extrusions.

Referring to FIG. 2, first mounting system 10 also includes a joint insulator 30. Joint insulator 30 is coupled to mounting rail 24 and extends below a bottom portion of mounting rail 24 between first architectural surface 4 and fire barrier 8. Joint insulator 30 is formed from flexible material such that joint insulator 30 can be folded. In a specific embodiment, joint insulator 30 is folded such that a first end 32 of joint insulator 30 and a second end 34 of joint insulator 30 are in contact with mounting rail 24. When laid flat, joint insulator 30 has a length between first end 32 and second end 34 of between 4 inches and 24 inches. In a specific embodiment, joint insulator 30 has a length of about 12 inches when laid flat. When folded and coupled to mounting rail 24, joint insulator has a length extending below mounting rail 24 of between 3 and 12 inches. In a specific embodiment, joint insulator 30 has a length extending below mounting rail 24 of about 6 inches when folded and coupled to mounting rail 24. Joint insulator 30 provides constant pressure to first architectural surface 4 and fire barrier 8 such that gases, flames, or smoke are prevented or limited from passing between first architectural surface 4 and fire barrier 8 in the event of a fire.

Joint insulator 30 is formed from fire-resistant protective materials. In some embodiments, the fire-resistant protective materials forming joint insulator 30 include a mineral wool layer, an intumescent layer, and a scrim paper layer. In a specific embodiment, the fire-resistant protective materials forming joint insulator 30 includes a plurality of wool layers, intumescent layers, and scrim paper layers. The mineral wool layers are configured to limit heat transfer to mounting rail 24 and retaining bracket 26 in the event of a fire. The intumescent layers are configured to activate when heated and swell, thereby further reducing heat transfer to mounting rail 24 and retaining bracket 26. The scrim paper layers are configured to provide additional structural integrity to joint insulator 30 and protect the other layers of joint insulator 30.

Second mounting system 12 includes a mounting plate 36 that extends into and is coupled to the second side 20 of fire barrier 8. Mounting plate 36 is rigidly coupled to second architectural surface 6 by mounting fasteners 28. In some embodiments, second mounting system 12 is substantially similar to first mounting system 10 such that second mounting system 12 includes similar components to first mounting system 10 as discussed herein and is assembled in the same manner as first mounting system 10.

Figure 3:
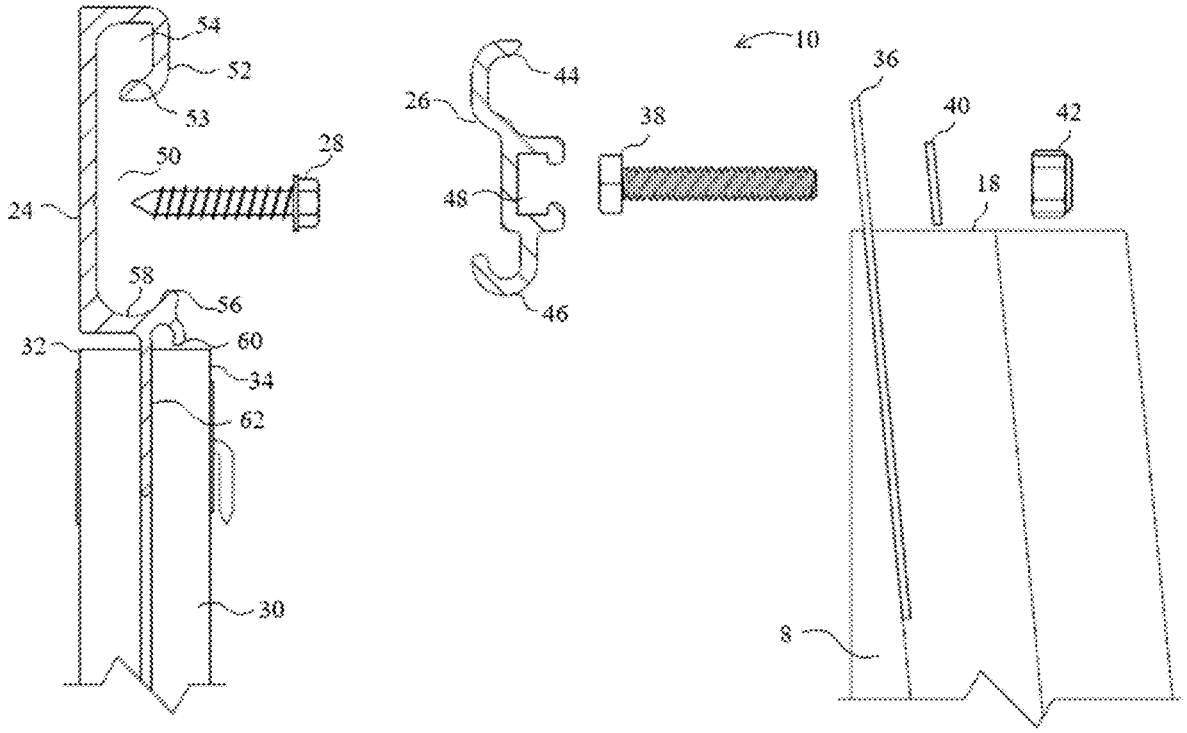
FIG. 3 is an exploded view of a mounting system of a fire barrier system, according to an exemplary embodiment.

Referring to FIG. 3, first mounting system 10 includes a mounting plate 36, a plurality of fire barrier fasteners 38, a plurality of washers 40, and a plurality of nuts 42. Mounting plate 36 extends into and is coupled to the first side 18 of fire barrier 8. As shown in FIG. 3, retaining bracket 26 includes a hook end 44, a rounded end 46, and a fastener channel 48. Hook end 44 extends above fastener channel 48 and has a generally arcuate shape. Rounded end 46 extends below fastener channel 48, opposite hook end 44, and has a generally arcuate shape. Fastener channel 48 extends in lateral direction 14 along retaining bracket 26 and is configured to receive the heads of fire barrier fasteners 38 to coupled fire barrier fasteners 38 to retaining bracket 26. Fire barrier fasteners 38 pass through mounting plate 36, washers 40, and nuts 42. Nuts 42 can rotate along threading of fire barrier fasteners 38 to clamp and secure mounting plate 36 and washers 40 to retaining bracket 26, thereby coupling fire barrier 8 to retaining bracket 26.

Mounting rail 24 includes a mounting channel 50, a hook receiver 52 that defines an upper cavity 54, a rounded lip 56, and a concave arcuate wall 58. Mounting channel 50 extends along mounting rail 24 in the lateral direction 14 and is configured to receive and releasably retain retaining bracket 26. Hook receiver 52 extends downward from the top of mounting rail 24 and inward toward first architectural surface 4 such that hook receiver 52 includes a ledge 53. Upper cavity 54 is located between ledge 53 and the top of mounting rail 24. Concave arcuate wall 58 is located at the bottom of mounting channel 50 and forms a portion of the perimeter of mounting channel 50. Rounded lip 56 is located at an end of concave arcuate wall 58 and protrudes upward with respect to the bottom of mounting rail 24. Concave arcuate wall 58 and rounded lip 56 are configured to releasably retain the rounded end 46 of retaining bracket 26.

Referring to FIG. 3, mounting rail 24 includes a support protrusion 60 and a coupling plate 62. Support protrusion 60 extends downward from rounded lip 56 toward joint insulator 30. Coupling plate 62 extends from the bottom of mounting rail 24 and forms a lower portion of mounting rail 24. In a specific embodiment, coupling plate 62 is coupled to both first end 32 and second end 34 of joint insulator 30 such that coupling plate 62 is sandwiched between portions of joint insulator 30.

Figure 4A:
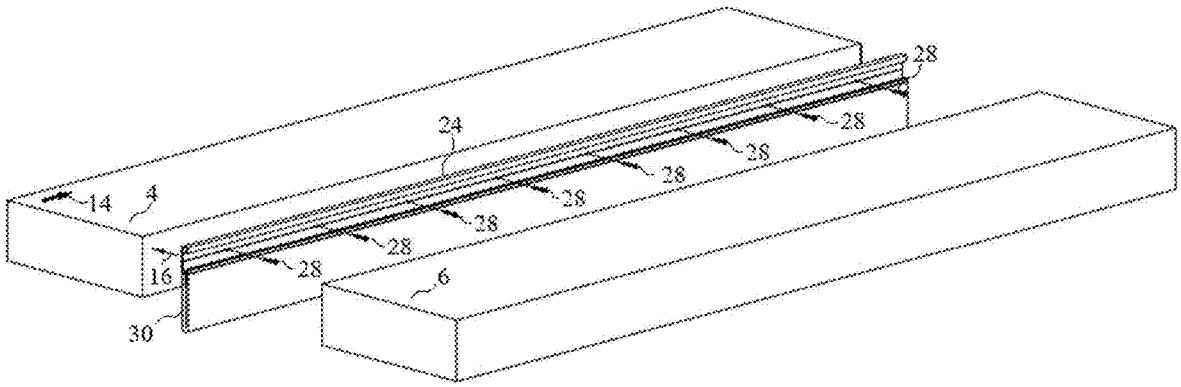
FIG. 4A is an exploded view of a mounting rail for a fire barrier system placed in a gap between two floor sections, according to an exemplary embodiment.
Figure 4B:
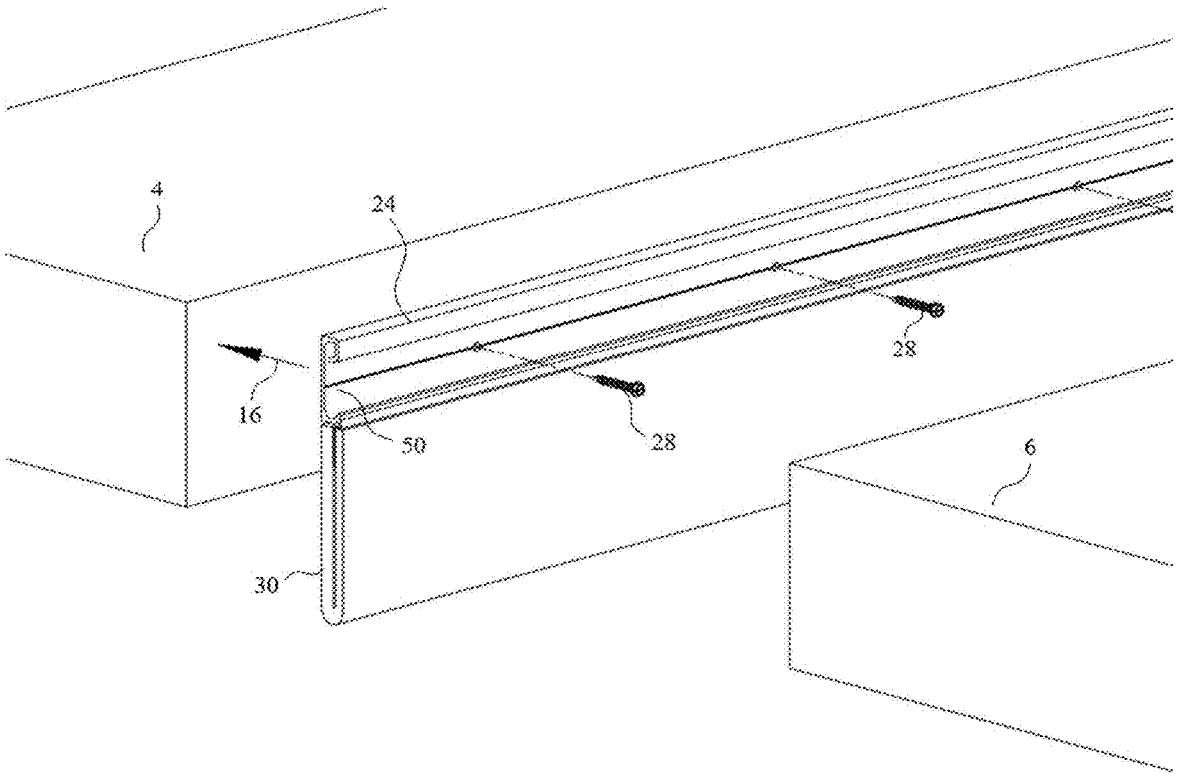
FIG. 4B is a detailed view of the mounting rail shown in FIG. 4A, according to an exemplary embodiment.

As shown in FIG. 4A, first mounting system 10 includes a plurality of mounting fasteners 28 that are spaced apart in the lateral direction 14. Referring to FIG. 4B, mounting fasteners 28 are oriented in the longitudinal direction 16.

Figure 5A:
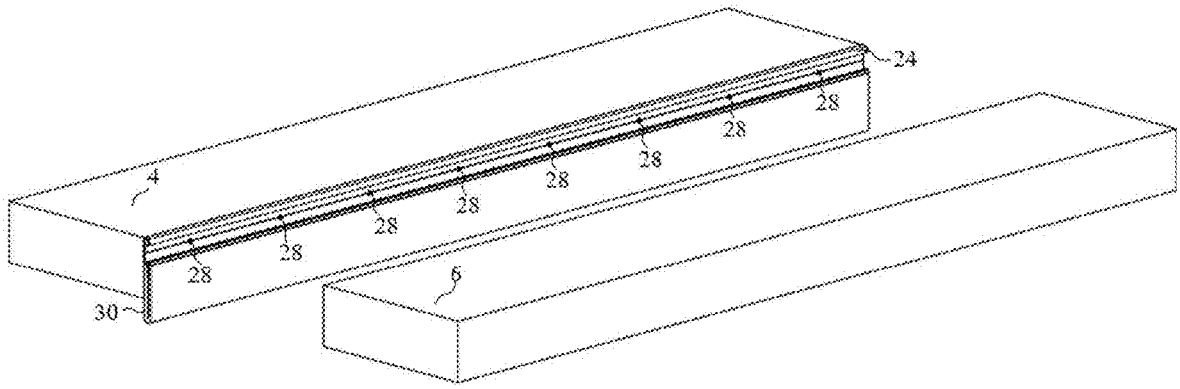
FIG. 5A is a perspective view of a mounting rail for a fire barrier system coupled to a first floor section within a gap between the first floor section and a second floor section, according to an exemplary embodiment.
Figure 5B:
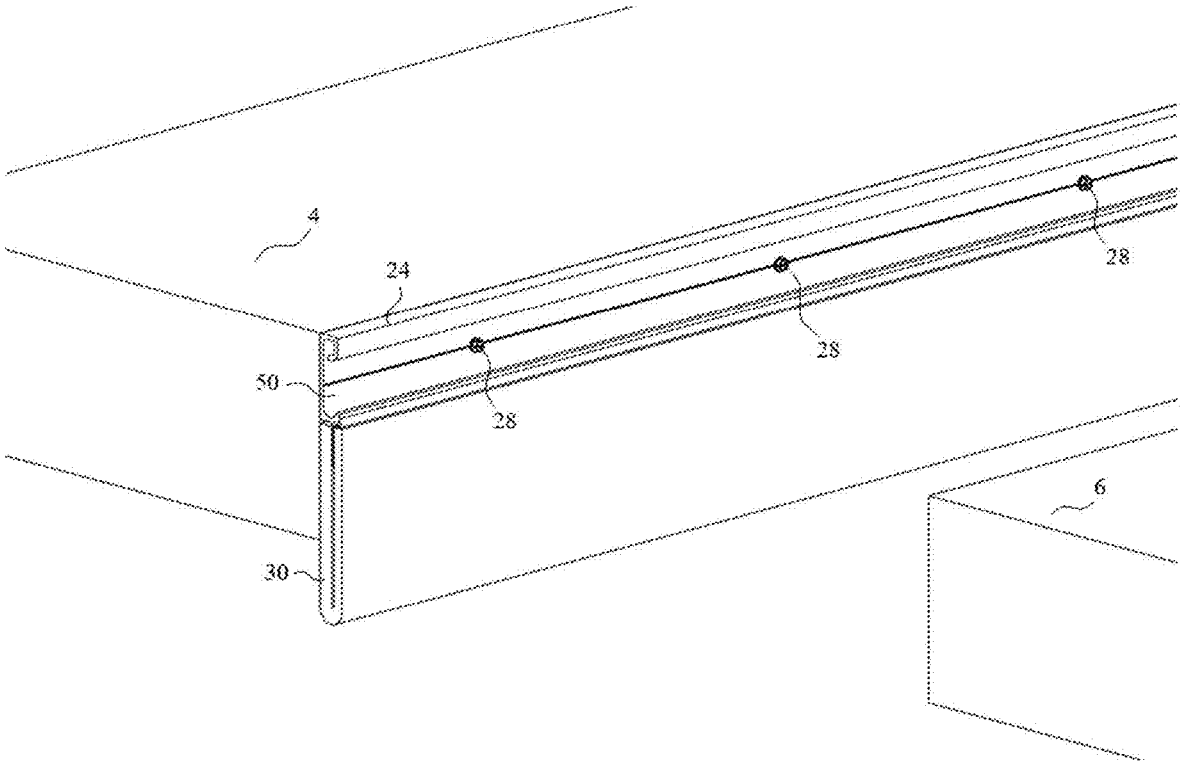
FIG. 5B is a detailed view of the mounting rail shown in FIG. 5A, according to an exemplary embodiment.

To assemble fire barrier assembly 2, mounting rail 24 is first placed between first architectural surface 4 and second architectural surface 6. As shown in FIG. 5A, mounting rail 24 is then pressed against the first architectural surface 4 such that a surface of mounting rail 24 is flush with first architectural surface 4. Referring to FIG. 5B, mounting fasteners 28 are inserted into mounting rail 24 and first architectural surface 4 to couple mounting rail 24 to first architectural surface 4. Joint insulator 30 is in contact with first architectural surface 4.

Figure 6A:
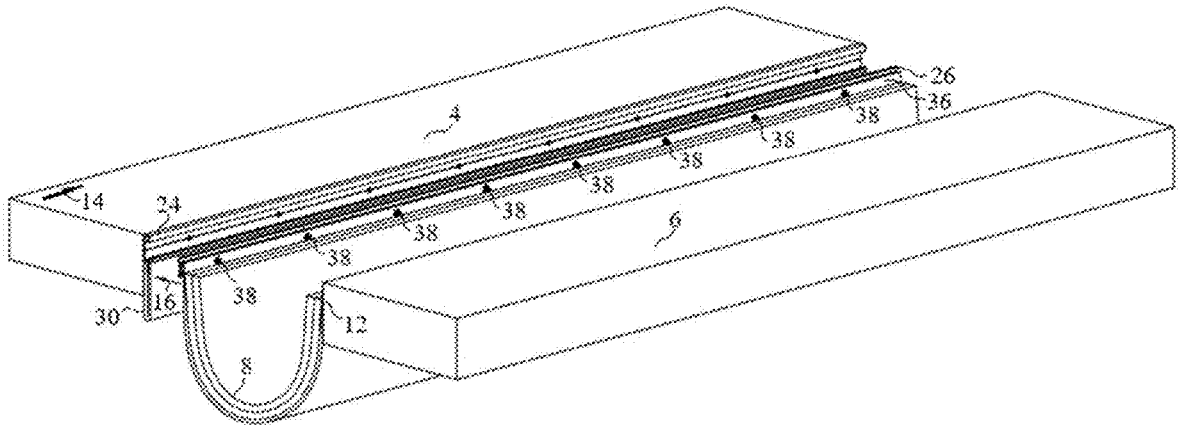
FIG. 6A is a perspective view of a fire barrier system placed in a gap between a first floor section and a second floor section in which the fire barrier is detached from a mounting rail coupled to the first floor section, according to an exemplary embodiment.
Figure 6B:
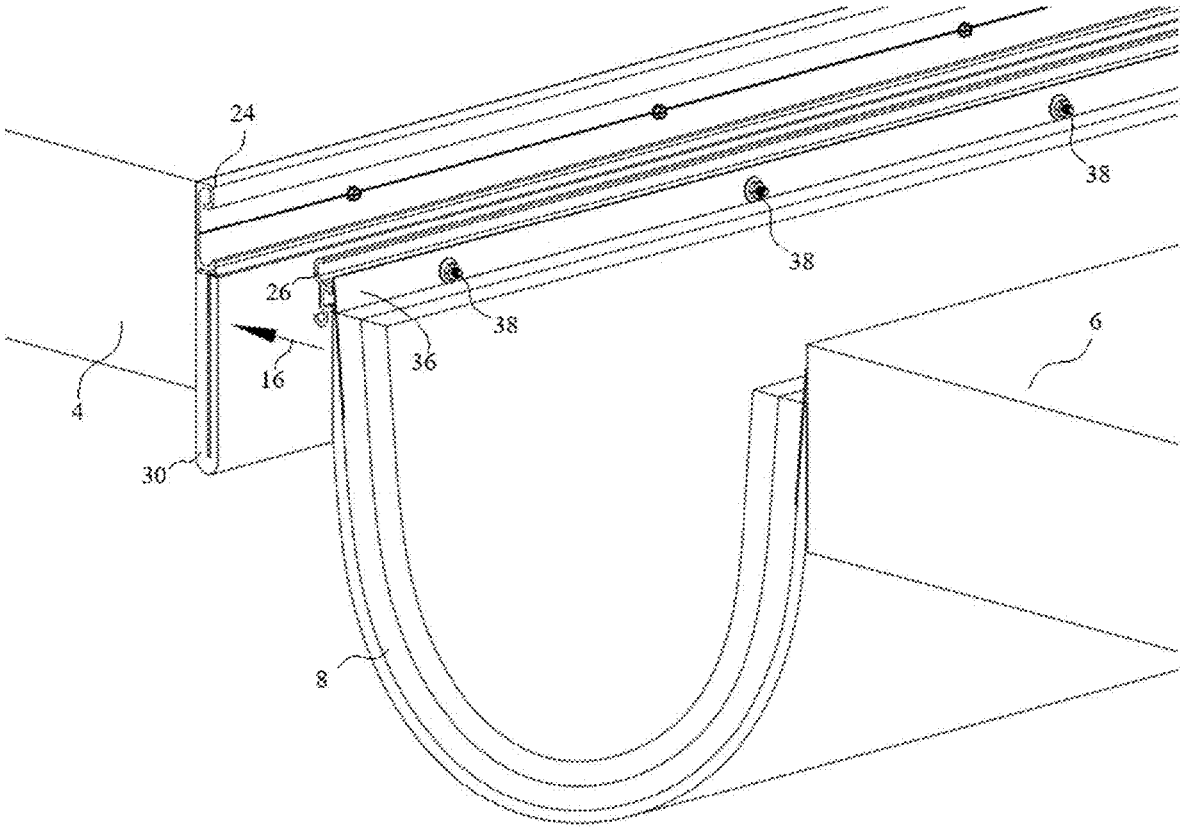
FIG. 6B is a detailed view of the fire barrier system shown in FIG. 6A, according to an exemplary embodiment.

Referring to FIG. 6A, fire barrier 8 is then coupled to second architectural surface 6 by second mounting system 12. Fire barrier 8 extends in the longitudinal direction 16 from second architectural surface 6 toward first architectural surface 4. As shown in FIG. 6B, fire barrier 8 is coupled to mounting plate 36 and retaining bracket 26 by a plurality of fire barrier fasteners 38 that are spaced apart from each other in the lateral direction 14. Retaining bracket 26 is moved toward mounting rail 24 in the longitudinal direction 16 to releasably attach retaining bracket 26 to mounting rail 24 and assemble first mounting system 10. In an alternative embodiment, fire barrier 8 is coupled to retaining bracket 26 after retaining bracket 26 is coupled to mounting rail 24.

Figure 7A:
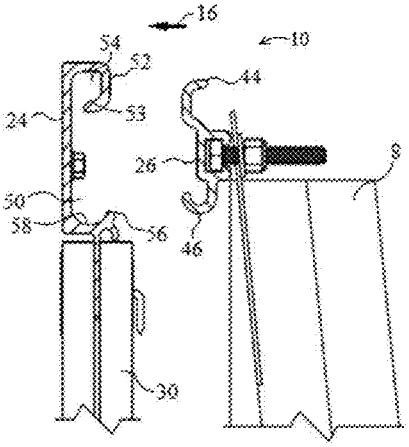
FIG. 7A is a detailed view of a mounting system of a fire barrier system in which a retaining bracket of the mounting system is not attached to a mounting rail of the mounting system, according to an exemplary embodiment.
Figure 7B:
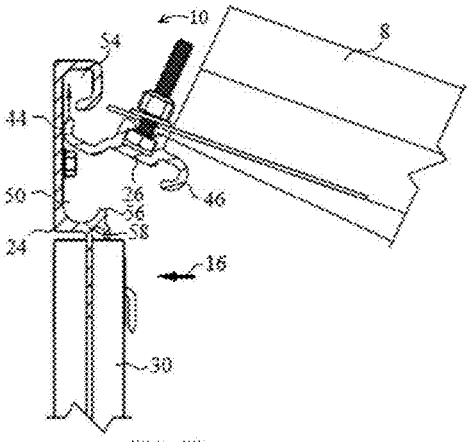
FIG. 7B is a detailed view of a mounting system of a fire barrier system in which the mounting system is partially assembled, according to an exemplary embodiment.

Referring to FIGS. 7A-7E, steps included in a method for assembling first mounting system 10 are shown, according to an exemplary embodiment. As shown in FIGS. 7A and 7B, retaining bracket 26 is moved toward mounting rail 24 in the longitudinal direction 16. Retaining bracket 26 is rotated about an axis that extends in the lateral direction 14 such that hook end 44 is lowered with respect to rounded end 46 and the edge of hook end 44 is angled upward. Retaining bracket 26 is then inserted into mounting rail 24. Specifically, hook end 44 of retaining bracket 26 is inserted into an opening of mounting channel 50 from the longitudinal direction 16.

Figure 7C:
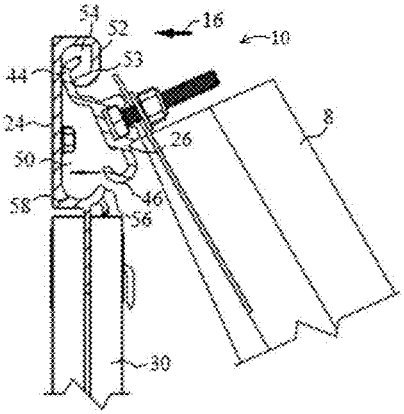
FIG. 7C is a detailed view of a mounting system of a fire barrier system in which the mounting system is partially assembled, according to an exemplary embodiment.
Figure 7D:
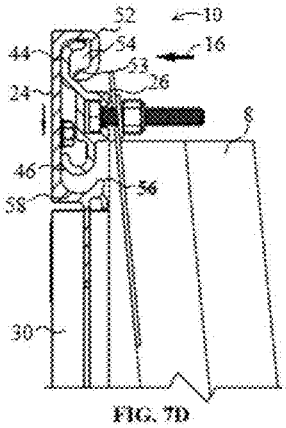
FIG. 7D is a detailed view of a mounting system of a fire barrier system in which the mounting system is partially assembled, according to an exemplary embodiment.

As shown in FIGS. 7B and 7C, hook end 44 is then raised and inserted into upper cavity 54. Retaining bracket 26 is rotated about an axis extending in the lateral direction 14 such that rounded end 46 is lowered with respect to hook end 44. Referring to FIGS. 7C and 7D, as retaining bracket 26 is rotated, rounded end 46 moves in the longitudinal direction 16 into mounting channel 50. As shown in FIG. 7D, when hook end 44 and rounded end 46 of retaining bracket 26 are both within mounting channel 50, fire barrier 8 is in direct contact with joint insulator 30.

Figure 7E:
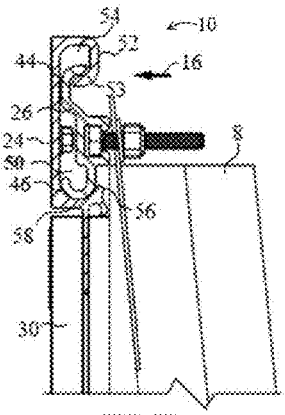
FIG. 7E is a detailed view of an assembled mounting system of a fire barrier system, according to an exemplary embodiment.

Referring to FIGS. 7D and 7E, retaining bracket 26 is then lowered within mounting channel 50. Hook end 44 is lowered within upper cavity 54 until hook end 44 engages with ledge 53 of hook receiver 52. Rounded end 46 is lowered into contact with concave arcuate wall 58. Concave arcuate wall 58 has a radius of curvature that is greater than or equal to the radius of curvature of rounded end 46 such that rounded end 46 fits within the curve of concave arcuate wall 58. Concave arcuate wall 58 and rounded lip 56 cooperate to retain rounded end 46 within the curve of concave arcuate wall 58 when downward forces are applied to retaining bracket 26 or when forces are applied to retaining bracket 26 in the longitudinal direction 16 away from mounting rail 24.

As shown in FIG. 7E, first mounting system 10 is assembled when retaining bracket 26 is within mounting channel 50 such that hook end 44 engages ledge 53 and/or when rounded end 46 is retained in the curve of concave arcuate wall 58. Retaining bracket 26 is releasably retained within mounting rail 24 such that first mounting system 10 can be disassembled by reversing the method discussed above. To disassemble first mounting system 10, retaining bracket 26 can be raised with respect to mounting rail 24 and rotated about an axis extending in the lateral direction 14 such that rounded end 46 is removed from mounting channel 50. Retaining bracket 26 can then be moved in the longitudinal direction 16 away from mounting rail 24 to remove retaining bracket 26 from mounting channel 50.

Figure 8:
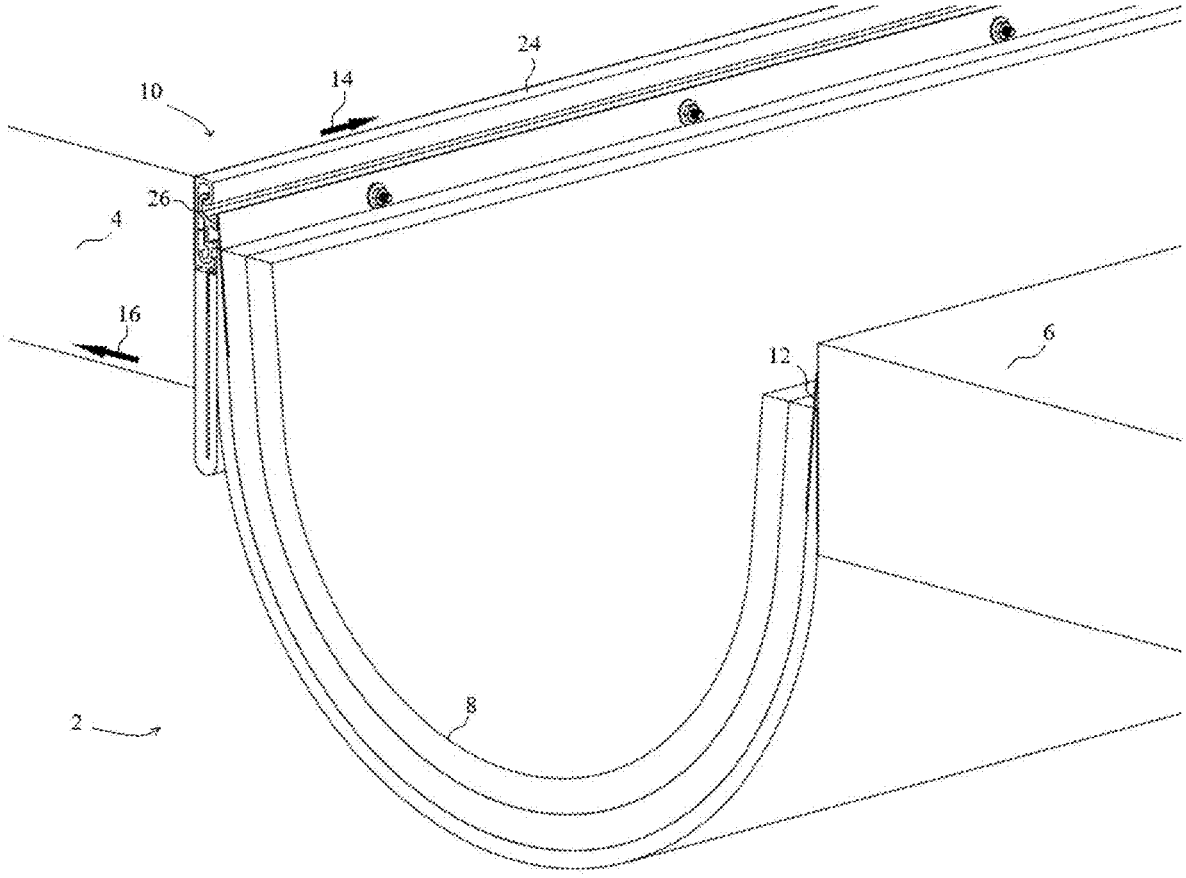
FIG. 8 is a detailed view of the fire barrier system of FIG. 1, according to an exemplary embodiment.

Fire barrier assembly 2 is shown in an assembled state in FIG. 8, according to an exemplary embodiment. When first mounting system 10 is assembled, retaining bracket 26 extends within mounting rail 24 in the lateral direction 14. Retaining bracket 26 and mounting rail 24 are configured to allow retaining bracket 26 to slide in the lateral direction 14 with respect to mounting rail 24. The sliding relationship between retaining bracket 26 and mounting rail 24 accommodates lateral movement of first architectural surface 4 with respect to second architectural surface 6, such as in response to expansions or contractions from temperature changes or from seismic activity. First mounting system 10 is configured to maintain contact between fire barrier assembly 2 and both first architectural surface 4 and second architectural surface 6 when first architectural surface 4 and second architectural surface 6 move laterally with respect to each other.

Fire barrier 8, first mounting system 10, and second mounting system 12 cooperate to extend across and cover the gap between first architectural surface 4 and second architectural surface 6. In various embodiments, fire barrier 8 extends a length in the lateral direction 14 of between about 4 feet and about 10 feet. Fire barrier assembly 2 can include a plurality of fire barriers 8 arranged in series along first architectural surface 4 and second architectural surface 6 in the lateral direction 14. The plurality of fire barriers 8 can be staggered, such as in the longitudinal direction 16, to limit heat transfer in the gaps between fire barriers 8.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "about," when referring to a length or distance (e.g., a length of about 10 inches), means within 10 percent above or below the referenced value (e.g., between 9 and 11 inches).

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. As used herein, the article "a" is intended to include one or more component or element and is not intended to be construed as meaning only one.

What is claimed is:

1. A fire barrier system configured to cover a gap between a first architectural surface and a second architectural surface, the fire barrier system comprising:

a fire barrier fabricated from a fire-resistant protective material, the fire barrier comprising:
- a first side;
- a second side; and
- a middle section draped between the first side and the second side;

a first mounting system coupled to the first side of the fire barrier and to the first architectural surface, the first mounting system comprising:
- a mounting rail coupled to the first architectural surface and extending in a lateral direction along the first architectural surface, the mounting rail including a mounting channel that extends in the lateral direction, a hook receiver, a concave arcuate wall, and a rounded lip, wherein the concave arcuate wall forms a portion of the perimeter of the mounting channel; and a retaining bracket coupled to the first side of the fire barrier, the retaining bracket including a hook end and a rounded end opposite the hook end;

a second mounting system coupled to the second side of the fire barrier and to the second architectural surface;

wherein the retaining bracket is configured to be inserted into the mounting channel from a longitudinal direction that is perpendicular to the lateral direction such that the hook end of the retaining bracket engages the hook receiver of the mounting rail, and the concave arcuate wall and the rounded lip of the mounting rail cooperate to retain the rounded end of the retaining bracket within the mounting channel.

2. The fire barrier system of claim 1, wherein, when the retaining bracket is inserted into the mounting channel, the retaining bracket is configured to slide in the lateral direction with respect to the mounting rail.

3. The fire barrier system of claim 1, wherein a distance between the first mounting system and the second mounting system is at least 6 inches.

4. The fire barrier system of claim 1, the first mounting system further comprising a first insulator extending from a bottom portion of the mounting rail, the first insulator comprising:

one or more mineral wool layers;

one or more scrim paper layers; and one or more intumescent layers.

5. The fire barrier system of claim 4, wherein the first insulator is folded such that the bottom portion of the mounting rail is sandwiched between a first end of the first insulator and a second end of the first insulator.

6. The fire barrier system of claim 1, wherein the mounting rail and the retaining bracket each comprise aluminum and are formed by an aluminum extrusion process.

7. The fire barrier system of claim 1, the first mounting system further comprising:

a first fire barrier mounting plate coupled to the fire barrier;

a fastener channel formed by the retaining bracket;

a plurality of retaining fasteners coupled to the retaining bracket within the fastener channel and coupled to the first fire barrier mounting plate.

8. The fire barrier system of claim 1, further comprising a plurality of mounting fasteners that couple the first mounting system to the first architectural surface and couple the second mounting system to the second architectural surface.

9. A fire barrier system configured to cover a gap between a first architectural surface and a second architectural surface, the fire barrier system comprising:

a fire barrier fabricated from fire-resistant protective materials, the fire barrier comprising:

a first side;

a second side; and a middle section draped between the first side and the second side;

a first mounting system coupled to the first side of the fire barrier and to the first architectural surface, the first mounting system comprising:

a mounting rail coupled to the first architectural surface and extending in a lateral direction along the first architectural surface, the mounting rail including a mounting channel that extends in the lateral direction and a hook receiver defining an upper cavity; and a retaining bracket coupled to the first side of the fire barrier, the retaining bracket including a hook end; and a first insulator extending from a bottom portion of the mounting rail, wherein the first insulator is folded such that the bottom portion of the mounting rail is sandwiched between a first end of the first insulator and a second end of the first insulator; and a second mounting system coupled to the second side of the fire barrier and to the second architectural surface;

wherein the mounting rail and retaining bracket are configured such that the hook end of the retaining bracket can be inserted into the upper cavity of the hook receiver and the retaining bracket can then rotate with respect to the mounting rail into the mounting channel to couple the retaining bracket to the mounting rail, the retaining bracket rotating about an axis extending in the lateral direction.

10. The fire barrier system of claim 9, the mounting rail further comprising a concave arcuate wall forming a portion of a perimeter of the mounting channel;

the retaining bracket further comprising a rounded end opposite the hook end; and wherein the rounded end of the retaining bracket is in contact with the concave arcuate wall of the mounting rail when the retaining bracket is coupled to the mounting rail.

11. The fire barrier system of claim 9, wherein, when the retaining bracket is coupled to the mounting rail, the retaining bracket is configured to slide in the lateral direction with respect to the mounting rail.

12. The fire barrier system of claim 9, wherein a distance between the first mounting system and the second mounting system is at least 6 inches.

13. The fire barrier system of claim 9, the first insulator comprising:

one or more mineral wool layers;

one or more scrim paper layers; and one or more intumescent layers.

14. The fire barrier system of claim 9, wherein a coupling plate extends from the bottom portion of the mounting rail, and wherein the coupling plate is positioned between the first insulator and the second end of the first insulator.

15. The fire barrier system of claim 9, wherein the mounting rail and the retaining bracket each comprise aluminum and are formed by an aluminum extrusion process.

16. The fire barrier system of claim 9, the first mounting system further comprising:

a first fire barrier mounting plate coupled to the fire barrier;

a fastener channel formed by the retaining bracket;

a plurality of retaining fasteners coupled to the retaining bracket within the fastener channel and coupled to the first fire barrier mounting plate.

17. The fire barrier system of claim 9, further comprising a plurality of mounting fasteners that couple the first mounting system to the first architectural surface and couple the second mounting system to the second architectural surface.

18. A method for installing a fire barrier system configured to cover a gap between a first architectural surface and a second architectural surface, the method comprising:

coupling a mounting rail to the first architectural surface, the mounting rail extending in a lateral direction along the first architectural surface and including a mounting channel that extends in the lateral direction and a hook receiver defining an upper cavity;

coupling a mounting system to the second architectural surface;

coupling a retaining bracket to the mounting rail by inserting a hook end of the retaining bracket into the mounting channel from a longitudinal direction that is perpendicular to the lateral direction, raising the hook end of the retaining bracket into the upper cavity of the mounting rail, and rotating the retaining bracket with respect to the mounting rail into the mounting channel such that the hook end of the retaining bracket engages the hook receiver of the mounting rail to releasably retain the retaining bracket in the mounting channel of the mounting rail, the retaining bracket rotating about an axis extending in the lateral direction;

coupling a first side of a fire barrier to the mounting system;

coupling a second side of the fire barrier to the retaining bracket;

wherein the fire barrier is fabricated from fire-resistant protective materials and includes a middle section draped between the first side and the second side.

19. The method of claim 18, wherein the fire barrier is coupled to the retaining bracket before the retaining bracket is coupled to the mounting rail.

20. The method of claim 18, wherein the retaining bracket is coupled to the mounting rail before the fire barrier is coupled to the retaining bracket.

21. A fire barrier system configured to cover a gap between a first architectural surface and a second architectural surface, the fire barrier system comprising:

a fire barrier fabricated from a fire-resistant protective material, the fire barrier comprising:

a first side;

a second side; and a middle section draped between the first side and the second side;

a first mounting system coupled to the first side of the fire barrier and to the first architectural surface, the first mounting system comprising:

a mounting rail coupled to the first architectural surface and extending in a lateral direction along the first architectural surface, the mounting rail including a mounting channel that extends in the lateral direction, a hook receiver, and a rounded lip;

a retaining bracket coupled to the first side of the fire barrier, the retaining bracket including a hook end and a rounded end; and a first insulator extending from a bottom portion of the mounting rail, wherein the first insulator is folded such that the bottom portion of the mounting rail is sandwiched between a first end of the first insulator and a second end of the first insulator, the first insulator comprising:

one or more mineral wool layers;

one or more scrim paper layers; and one or more intumescent layers;

a second mounting system coupled to the second side of the fire barrier and to the second architectural surface; and wherein the retaining bracket is configured to be inserted into the mounting channel from a longitudinal direction that is perpendicular to the lateral direction such that the hook end of the retaining bracket engages the hook receiver of the mounting rail, and the rounded lip of the mounting rail retains the rounded end of the retaining bracket.

* * * * *